US007025451B2

(12) United States Patent
Mabbott

(10) Patent No.: US 7,025,451 B2
(45) Date of Patent: Apr. 11, 2006

(54) IMAGE TRANSFER ONTO NON-PLANAR SURFACES

(76) Inventor: Robert John Mabbott, 69 Thornsett, Birch Vale, High Peak, Derbyshire (GB), SK22 1AZ ( * ) Notice: Subject to any disclaimer, the term of this patent is extended or adjusted under 35 U.S.C. 154(b) by 147 days.

(21) Appl. No.: 10/276,442

(22) PCT Filed: May 16, 2001

(86) PCT No.: PCT/GB01/02128

§ 371 (c)(1),
(2), (4) Date: Jan. 14, 2003

(87) PCT Pub. No.: WO01/87643

PCT Pub. Date: Nov. 22, 2001

(65) Prior Publication Data

US 2004/0090507 A1 May 13, 2004

(30) Foreign Application Priority Data

May 16, 2000 (GB) ..... 0011642

(51) Int. Cl.
*B41J 2/01* (2006.01)
*B41F 17/00* (2006.01)

(52) U.S. Cl. ..... 347/103; 101/35

(58) Field of Classification Search ..... 347/103; 101/35
See application file for complete search history.

(56) References Cited

U.S. PATENT DOCUMENTS 6,092,465 A * 7/2000 Agronin ..... 101/478

FOREIGN PATENT DOCUMENTS

| | | | |
|---|---|---|---|
| JP | 58 118211 | 7/1983 | |
| JP | 59 204541 | 11/1984 | |
| JP | 60-021290 | * 2/1985 | ..... 101/35 |

* cited by examiner

*Primary Examiner*—Michael S. Brooke
(74) *Attorney, Agent, or Firm*—W. Thomas Timmons

(57) ABSTRACT

A method for transferring an image onto a non-planar surface in which an image transfer sheet comprising a shape memory polymer or like substance is used to transfer said image.

13 Claims, 3 Drawing Sheets

IMAGE TRANSFER ONTO NON-PLANAR SURFACES

This Application is a U.S. National filing under §371 of International Application No. PCT/GB01/02128, filed 16 May 2001, claiming priority from British Appln. No. 0011642.6, filed 16 May 2000, now pending (which is hereby incorporated by reference).

This invention relates to image transfer sheets, and methods for transferring images using them onto non-planar surfaces.

Although many methods exist for transferring images onto myriad surfaces, difficulties are encountered if the surfaces are not planar. Known techniques, using decals, labels, paint and printing ink can be used to apply images to the surface of three dimensional, non-planar objects in conventional manner, but such methods are less than ideal.

Decals and labels that are either made of paper or film can be printed and applied to a non-planar surface and either put on automatically by expensive machinery or physically by a manual worker. Decals and labels can only be applied to one surface at a time. When applying decals and labels to, for example, toys, a recessed area that is pre-formed to, or situated just above the height of the decal has to be designed into the casting in order to conform to the required tamper proof legislation that exists, especially in the toy market.

Waterslide decals are always applied by hand and although the area around the image is for the most part trasparent, there is a degree of post finishing that needs to be carried out, in order to produce the final finished product. This is a slow process and requires a high degree of manual dexterity and even then the wastage is high.

Hand painting can be employed, and in fact is possibly the most widely used decoration technique. However, hand painting is very slow, and labour intensive.

Pad printing, although applied as single pass colour, is predominately used on smaller toy products on a production line. The method is reliable, but suffers in a number of areas, such as registration, cost and versatility of image, quality of image and processing time.

The present invention addresses the above named problems, and provides a convenient and effective way of providing high quality image transfer onto non-planar surfaces.

According to a first aspect of the invention there is provided a method for transferring an image onto a non-planar surface using an image transfer sheet comprising a shape memory polymer (SMP) or like substance.

The image transfer sheet may be brought into contract with the surface under a first set of predetermined conditions, thereby transferring the image to the surface. The first set of predetermined conditions may comprise the application of heat and the application of a force urging the image transfer sheet into contact with the surface. The force may be applied by way of the application of a vacuum.

The SMP on like substance may be caused to resume its original shape under a second set of predetermined conditions. The second set of predetermined conditions may comprise a reduction in the force, which may comprise loss of the vacuum.

Alternatively, the SWAP or like substance may be caused to adopt the shape of the surface under a second set of predetermined conditions. The second set of predetermined conditions may comprise the provision of an adhesive adhering the SMP or like substance to the surface. The force may be retained by maintaining the vacuum.

The material known as shape memory polymer, or SMP, is manufactured by Mitsubishi Heavy Industries, 630 Fifth Avenue, New York, N.Y. 10111, USA. It is a polyurethane material that it is easy to process and manufacture, quickly changes from "hard" to "soft" when heated, and can regain its original hardness quickly when cooled. It is the existence of a large and reversible change in elastic modulus across the glass transition temperature (Tg) which makes shape change and shape retention possible.

The range of hardness to softness can be customised and a broad range of transition temperatures can be chosen. When heated to the predetermined transition temperature Tg, SMP can easily be remoulded to take on a new shape when cooled. Once the SMP is again exposed to temperatures in excess of Tg, the memory effect urges the SMP to regain its original process shape. Standard SMP glass temperatures are 25, 35, 45 and 55° C., but specialised transition temperatures are available between −30 and 75° C.

FIG. 1 depicts the shape memory properties of SMP. It may be possible to modify or augment the SMP composition or even that different materials having similar properties might be developed. Such materials are within the ambit of the invention.

According to a second aspect of the invention there is provided an image transfer sheet comprising:

a SMP or like substance; and an image containing medium.

The image transfer sheet may flier comprise an image release system disposed between the SMP or like material and image containing medium. The image release system may comprise a silicone coating.

The image containing medium may comprise ink or toner.

The image transfer sheet may comprise a releasable carrier layer.

According to a third aspect of the invention there is provided the use of a SMP or like substance in image transfer onto a non-planar surface.

Methods and image transfer sheets in accordance with the invention will now be described with reference to the accompanying drawings, in which.

Figure 3A:
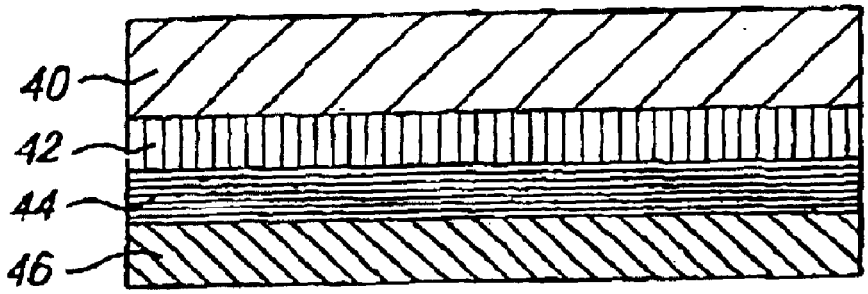
FIG. 3 shows a) a first embodiment, b) a second embodiment and c) a third embodiment of an image transfer sheet.
Figure 3B:
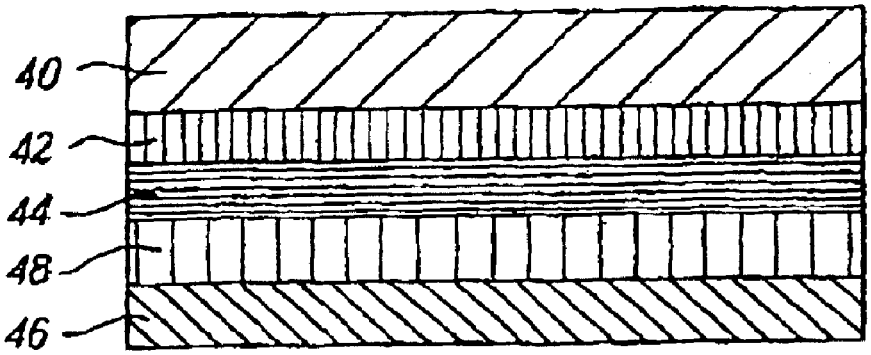
Figure 3C:
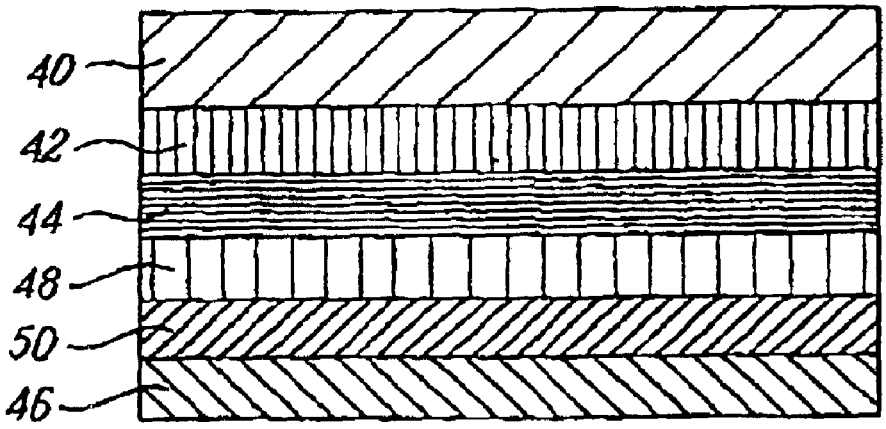

FIG. 3 depicts a number of possible embodiments of the image transfer sheet of the present invention. The skilled reader will appreciate that many further embodiments are possible. FIG. 3(*a*) depicts a first embodiment comprising a carrier layer 40 releasable on a release layer 42 from a layer of SMP 44. The image to be transferred is present in a layer of an image, containing medium 46. Surprisingly, it has been found that image transfer is possible under such conditions, in which the image containing medium is in direct contact with the SMP. In other words, it has been found that the SMP has hitherto unsuspected surface properties which enable it i) to serve as a carrier for the image containing medium and ii) to release the image containing medium so as to effect the image transfer.

Polymeric films such as polyethylene terephthalate (PET) might be used as the carrier layer 40. Representative film thickness are 18 to 24 μm. Coating the carrier layer 40 with a silicone release layer has been found to be advantageous, although other release systems, such as lacquers and wax, would readily suggest themselves to the skilled person. The SMP layer 44 typically is of a thickness between 30 and 100 μm, although this range should not be considered to be a limiting one. The image containing medium 46 is typically a toner or ink.

FIG. 3(*b*) depicts a second embodiment of an image transfer sheet which bears substantial similarity with the first embodiment. Thus, identical numerals to those employed it FIG. 3(*a*) are used to denote elements which are common to both embodiments. With the second embodiment shown in FIG. 3(*b*), the SMP layer 44 is coated with an image release system 48, such as a layer of silicone, prior to the application of the image containing medium 46. The image release system 48 permits control of the conditions of bond and release and thus affords improved control of the release of the image containing medium 46 from the SMP layer 44 onto the intended target surface.

FIG. 3(*c*) depicts a third embodiment of an image transfer sheet which bears substantial similarity with the second embodiment. Thus identical numerals to those employed in FIG. 3(*b*) are used to denote shared elements. The third embodiment further comprises an additional prove layer 50 of a flexible bard coat to add abrasion and scuff resistance to the finished, decorated product.

In preferred (but non-limiting) embodiments the image to be transferred is produced digitally, using software. The digital image is post scripted and sent to a suitable digital colour printing press. In some cases it may be necessary to pre-distort the image prior to printing in order to achieve precise registration. This can be performed in software.

The production of a digital image onto an image transfer sheet will now be described. A digital image can be printed onto the image transfer sheet using a digital printing press such as the Xeikon DCP 32/50S. The image transfer sheet can comprise one of the constructions described above.

Figure 1:
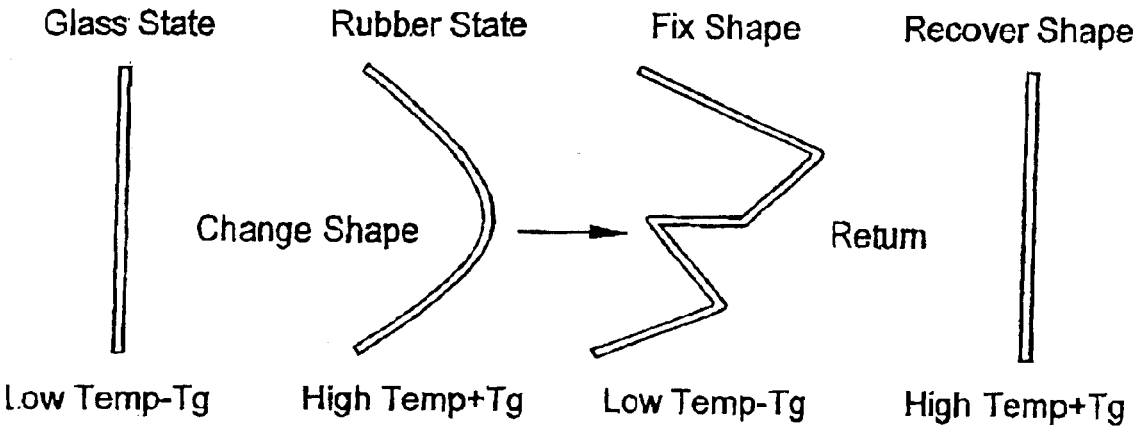
FIG. 1 shows the structural properties of SMP.
Figure 2:
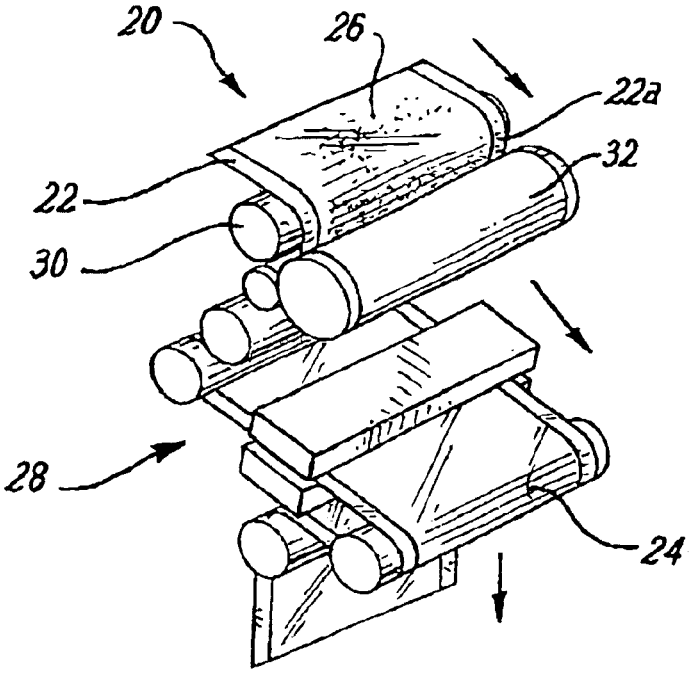
FIG. 2 shows the printing of an image onto an image transfer sheet.

FIG. 2 shows the backfusing of an image transfer sheet 20 which comprises a sheet release material 22 and an image layer 24. The direction of travel of the image transfer sheet 20 is shown with arrows. The sheet release material 22, with unfused dry toner medium 26 thereon, is fed into fusing apparatus, shown generally at 28. The sheet release material 22 is contacted with a first roller 30 at a temperature in the range 120 to 175° C., preferably 135 to 160° C., which is used to fuse the toner medium to the rear face of the release substrate.

After the step of fusing the toner medium, the front face 22*a* of the release substrate 22 is contacted with a second roller 32 at a lower temperature than the first roller 30, preferably less tan 120° C., most preferably less than 105° C. A temperature of about 99° C. has been found to be highly suitable. The temperature of this second roller 32, which is in direct contact with the toner medium, can be reduced to a point where there is no thermoplastic interface between the second roller 32 and the release material 22. The second roller 32 serves to compress the heated toner particles on to the surface of the release substrate 22.

The image transfer sheet 20 proceeds through the fusing apparatus 28 undergoing further processing steps which are well known in the art.

A particularly suitable fusing apparatus is a modified version of Xeikon DCP 32/50 S digital printing press (Xeikon, Vredebaan, Mortsel, Belgium). The conventional DCP 32/50 S press is adapted for conventional front fusing xerography. The DCP 32/50 S press has a heated roller generally at the position of roller 32 in FIG. 2, which acts on the front it of a substrate as a main fusing roller. The fusing roller is maintained at high temperature, typically in the range 135 to 160° C. Furthermore, the DCP 32/50 S press has a "pre-fusing" roller generally at the position of roller 30 in FIG. 2. This "pre-fusing" roller is typically kept at a temperature in the range 100 to 120° C., in order to apply a gentle heat to the back of the substrate thereby aiding the fusing process and smoothing the substrate prior to the main fusing step.

It has been found that it is possible to adapt the Xeikon DCP 32/50S to perform the method of the present invention by appropriate adjustment of the temperatures of the "pre-fusing" and "main" rollers, i.e., increasing the temperature of the former and decreasing the temperature of the latter. Very conveniently, this may be achieved through adaption of software running on the DCP 32/50 S press.

Alternatively, an image transfer scheme such as described in International Publication No. WO98/39166, the contents of which are hereby incorporated by reference, might be adapted for use in the present invention.

With the image printed onto the SMP film, the image transfer sheet is re-reeled, and the reel is removed and transported to an image transfer station. It may be possible to automate this transportation step, for example by directly trasporting the image transfer sheet to the image transfer station, possibly using rollers and/or a conveyor system.

There are a number of ways in which the image can be transferred to the non-planar object. Examples are discussed below:

| | |
|---|---|
| Non-selective Print Decoration | Application of an overall design or pattern to the entire surface of a 3D object and removal of SMP carrier. |
| Selective Print Decoration | Application of image to a portion of a 3D object and removal of SMP carrier. |
| Fixed Shape Print Decoration | Application of imaged SMP, bonding both image and SMP to the surface of a 3D object. |
| Hand Pressed Print Decoration | Hand application of either a selective or non-selective image area to the surface of a 3D object and removal of SMP carrier. |

Figure 4:
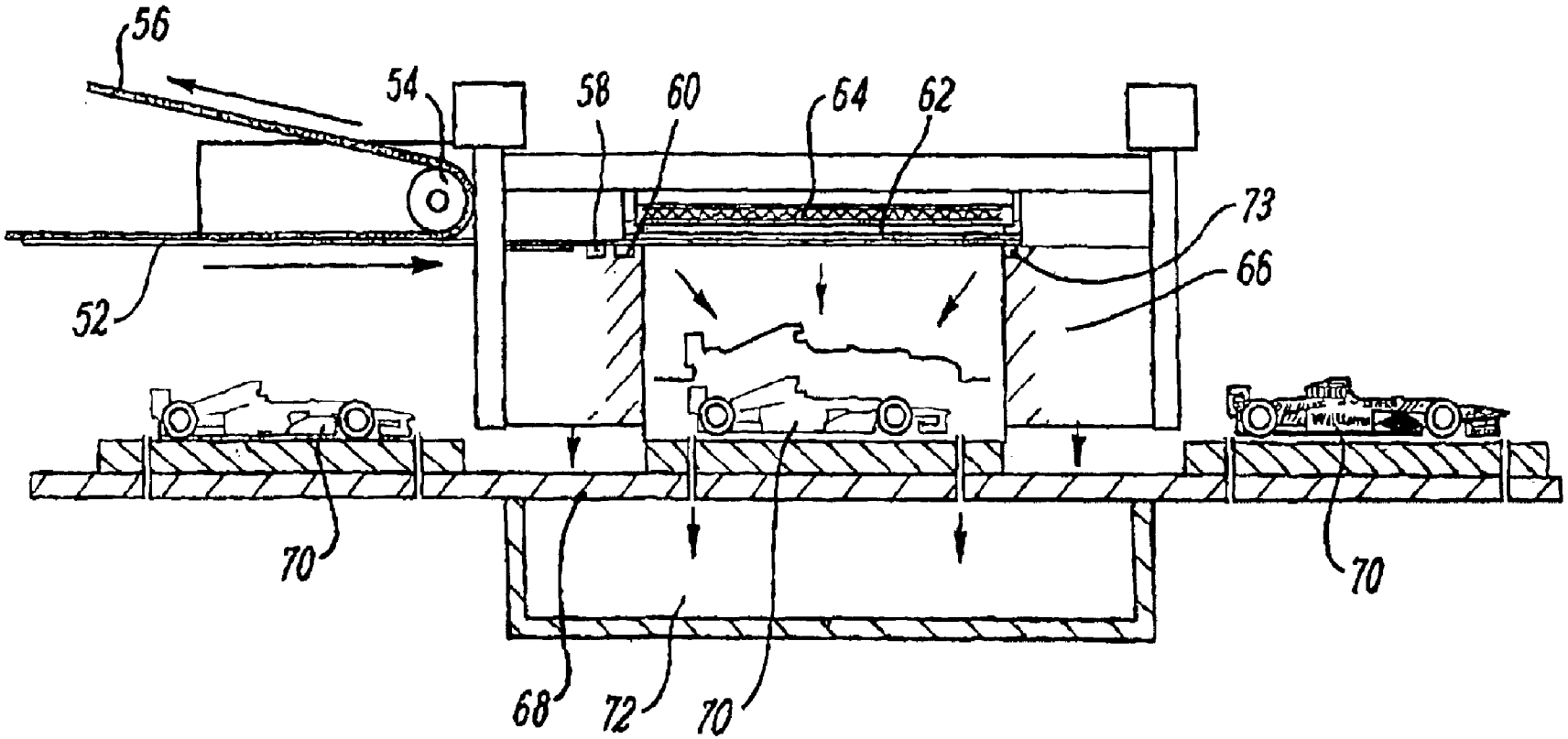
FIG. 4 is a schematic diagram of an image transfer station shown immediately after the flexible membrane has been withdrawn from the surface, but before it has regained its original shape.

An example of an image transfer station will now be described with reference to FIG. 4. The image transfer sheet 52 is transported to the station, and a take off roller 54 removes the carrier film 56 from the image transfer sheet 52. The remainder of the image transfer sheet 52, comprising SMP and image containing medium, is transported using film gripper 58 and film draw bar 60 into the station, bringing the image transfer sheet into contact with a flexible membrane 62. A heater 64 is disposed above the flexible membrane 62 and preferably in direct contact therewith. The station further comprises a housing 66, a conveyor 68 for transporting the non-planar target object 70, a vacuum system 72, and electronic sensor 73 to enable correct registration of the image transfer sheet 52. The non-planar object 70 depicted in FIG. 4 is a car, although it will be appreciated that many other non-planar objects, such as toys and cans, might have images transferred thereon. Multiple items might be introduced to the station for simultaneous image transfer. The precise design and dimensions of the station will likely be dependent on the precise application envisaged. For presentational purposes, the object 70 is shown in FIG. 4 three times: before, during and after image transfer.

FIG. 4 shows the housing 66 and heater 64 assembly in a raised position, allowing movement of the object 70 into and out of the station on the conveyor 68. The housing 66 and heater 64 assembly are moveable, and before image transfer takes place the assembly is lowered so that the housing 66 makes an air tight seal with the floor of the station. The heater 64 is heated to a suitable temperature above the Tg temperature of the SMP, thereby, softening the SMP so that it is formable. The vacuum system 72 creates a vacuum in the station, which pulls the image transfer sheet 52 and flexible membrane 62 down over the object 70, thereby permitting image transfer to occur. The vacuum is removed, and thus the flexible membrane 62 returns to the original position. Due to the memory properties of the SMP, the SMP will recover its original shape, leaving the image in place on the object 70. Alternatively, an adhesive might be used to adhere the SMP onto to the object 70. In this instance, the configuration of the SMP is fixed to the shape of the object 70.

The flexible membrane 62 should be able to withstand a wide range of temperatures above the Tg of the SMP, and preferably is translucent or semi-opaque.

The flexible membrane 62 can be a thin, flexible rubber sheet, preferably a siliconised rubber. Representative thicknesses are 0.2 to 0.8 mm. The SMP might be contacted to the flexible membrane 62 using a method of partial lamination, allowing the SMP and flexible membrane to move in uniformity until the vacuum process is complete. As noted above in one application, the thin film form images SMP would be permanently affixed to the object, in another, the SMP would be required to be removed, leaving just the image in place and in a further application the SMP would again be required to be removed but this time it would leave both the image and a top (scuff and abrasion) coat in place on the object.

Each of the applications requires the image to bond to the surface of the target object during the vacuum forming process, and different treatments might be made with regard to the image/substrate bonding process.

The treatment (adhesive and or coating) can be applied in three ways:

1/ To the target object

2/ To the images SMP surface.

3/ To both the object and the imaged SMP.

The treatment could be, either heat activated, UV curable or pressure sensitive, depending on the application and the production requirements.

Numerous variations are possible. For example, the housing might remain in a fixed position and the floor and object brought into air tight contact therewith. Rather than a vacuum, some other means, such as mechanical means, might apply a force so as to move the SMP into contact with the object.

What is claimed is:

1. A method for transferring an image onto a non-planar surface in which an image transfer sheet comprising a shape memory polymer or like substance is used to transfer said image, in which the image transfer sheet is brought into contact with the surface under a first set of predetermined conditions comprising the application of heat and the application of a force urging the image transfer sheet into contact with the surface, thereby transferring the image to the surface in which the force is applied by way of the application of a vacuum.

2. A method according to claims 1 in which the shape memory polymer or like substance is caused to resume its original shape under a second set of predetermined conditions.

3. A method according to claim 2 in which the second set of predetermined conditions comprises a reduction in the force.

4. A method according to claim 3 in which the second set of predetermined conditions comprises loss of the vacuum.

5. A method according to claim 1 in which the shape memory polymer or like substance is caused to adopt the shape of the surface under a second set of predetermined conditions.

6. A method according to claim 5 in which the second set of predetermined conditions comprises the provision of an adhesive adhering the SMP or like substance to the surface.

7. A method according to claim 6 in which the force is retained by maintaining the vacuum.

8. An image transfer system comprising:

an image transfer sheet comprising:

a shape memory polymer or like substance; and an image containing medium; and an image release system disposed between the shape memory polymer or like substance and image containing medium.

9. An image transfer system according to claim 8 in which the image release system comprises a silicone coating.

10. An image transfer system according to claim 9 further comprising a releasable carrier layer.

11. An image transfer system according to any of claims 8 to 9 in which the image containing medium comprises ink or toner.

12. An image transfer system according to claim 11 further comprising a releasable carrier layer.

13. An image transfer system according to claim 8 further comprising a releasable carrier layer.

* * * * *